United States Patent [19]

Rijnders

[11] 4,194,034

[45] Mar. 18, 1980

[54] FLOATING FENDER

[75] Inventor: Roderick F. R. T. Rijnders, Amersfoort, Netherlands

[73] Assignee: International B.F. Goodrich-Europe B.V., Netherlands

[21] Appl. No.: 962,013

[22] Filed: Nov. 20, 1978

Related U.S. Application Data

[63] Continuation-in-part of Ser. No. 851,305, Nov. 14, 1977, abandoned, which is a continuation of Ser. No. 643,019, Dec. 22, 1975, abandoned.

[30] Foreign Application Priority Data

Dec. 24, 1974 [NL] Netherlands ..... 7416838

[51] Int. Cl.[2] ..... B63B 59/02

[52] U.S. Cl. ..... 428/36; 260/42.33

[58] Field of Search ..... 114/219; 252/511; 260/42.33; 428/36

[56] References Cited

U.S. PATENT DOCUMENTS 3,963,647 6/1976 Straub ..... 252/511

FOREIGN PATENT DOCUMENTS 127197 11/1944 Australia ..... 252/511

OTHER PUBLICATIONS

Kraus. Gerard, Reinforcement of Elastomers, Interscience Pub., New York, 1965, pp. 324–326.

*Primary Examiner*—James H. Derrington

*Attorney, Agent, or Firm*—McGlew and Tuttle

[57] ABSTRACT

A floating fender consisting of a matrix, in solid form, made of rubber having a density not exceeding 0.91 which is free of gas-filled or air-filled closed pores, and from 5 to 20 parts by weight per one hundred parts by weight of the rubber of carbon black having a particle size smaller than 35 nanometers. The carbon black is dispersed throughout the matrix as a filler and the completed fender has an overall density not exceeding 0.97. The fender has a modulus at 25% elongation of at least 3.5 kg/cm$^2$ and a tear resistance of at least 10 kg/cm$^2$ and the carbon black incorporated as a filler in the solid form matrix is utilized solely for its small particle size and high structure, to wit a dibutyl phthalate oil absorption higher than 130 ml/100 gm and a specific surface greater than 130 m$^2$/gm.

4 Claims, No Drawings

FLOATING FENDER

This application is a continuation-in-part of application Ser. No. 851,305, filed Nov. 14, 1977, now abandoned, which is a continuation of application Ser. No. 643,019, filed Dec. 22, 1975, now abandoned.

FIELD AND BACKGROUND OF THE INVENTION

This invention relates in general to floating fenders and in particular to a new and useful fender made of rubber or an elastomer which is used as a floating fender for ships, drilling platforms and the like, that must be provisioned, loaded or unloaded in the open sea under high wind-forces, or for use in locks. The invention also provides a floating fender for use in connection with heavy-draught tanker-vessels, which may off-load a portion of their cargo into smaller tanker vessles, usually by pumping

DESCRIPTION OF THE PRIOR ART

Stable floting fenders, which absorb shocks and which separate two vessels, are highly desirable in difficult nautical maneuvers such as off-loading one large tanker vessel onto another smaller vessel.

Especially in the case of tanker-vessels of large dimensions, the external pressure exerted on the vessel's hull should preferably not exceed about 50 tons/m$^2$. This pressure limitation has led to the use of fenders of very large volume, so as to better distribute the pressure and reduce the large forces which would otherwise occur. The availability of limited manpower on board such large vessels has also led to the attempted use of such large units so that the number of fenders could be minimized.

The use of fenders of such large dimensions, however, has given rise to considerable problems in practice. For example, if use is made of an air-filled, ballon-shaped fender, connected to the vessel by one or more cables and floating of the water surface, not only is there a considerable chance of damage whereby the fender may sink and be lost, but also this construction has the disadvantage that the fender is easily thrown on board the vessel from its floating condition in rough weather, thus removing it from its proper position. This may lead both to the damaging of parts of the vessel and to accidents and injury involving the personnel of the vessel.

It is also known to use fenders of massive rubber having a density of more than 1.0 which are usually attached at their extremities to the vessel by means of cables, for which purpose a shaft or frame may be incorporated in the rubber material. An advantage of this construction is that, in comparison with the pneumatic fender, which follows each undulatory motion of the water, this massive fender can be suspended completely or partially under water, so that it remains in a constant position with respect to the vessel. A disadvantage, however, is that with contrasting movements of the two vessels the fender may be pushed downwardly, the cables may break and the fender may sink and get lost. Furthermore, as a result of rolling movements the two vessels may contact each other above or beneath the fender. Attempts have been made to overcome this last-mentioned disadvantage by manufacturing fenders which consist partly of massive rubber and partly of sponge or foam rubber, so that the overall density of the fender is less than 1.0 and a floating construction is obtained. Such fenders cannot sink. However, apart from problems arising during the manufacture of such large rubber articles of various composition, especially while vulcanizing them, it should be pointed out that such fenders are not particularly suitable for the heavy conditions of use to which they will be subjected. The use of foam or sponge rubber components always leads to a decrease in the rigidity and the tear resistance of the rubber article, which properties are of great importance for fenders. Also, on prolonged use with repeated compression and expansion of the fender, water may enter the body of the fender so the gas-bubbles cannot perform their function and the density rises above the 1.0 value.

SUMMARY OF THE INVENTION

An object of the present invention is to provide a floating rubber fender which has good mechanical properties and has a density of less than 1.0, preferably no more than 0.97, wherein the above-mentioned disadvantages of previous floating fenders have been overcome. The inventive fender consisting of a carbon black filled, solid (or massive) body of vulcanized rubber, free of gas-filled or air-filled closed pores.

It is clear that with such a density for the vulcanized rubber, a floating body can be formed, which even in fresh water, floats partially above the water surface, so that it is not necessary to hang the fender on cables, nor is the fender able to sink and be lost.

Saturated synthetic rubbers having a density lower than that of natural rubber are commercially available. Natural rubber and the type of synthetic rubber that is most often used have a density of 0.92. The so-called EPDM rubber (see *The Elastomers Manual,* edited 1974, page 7) has a density of about 0.86. However, reinforcing fillers have to be added to such elastomers to give the articles prepared therefrom the desired application properties.

In order to be usable in practice, fenders should be manufactured from a rubber mixture having, in vulcanized form, a modulus (at 25% of elongation) of at least 3.5 kg/cm$^2$ and a tear resistance in order to prevent tearing of at least 10 kg/cm$^2$ (determined according to the so-called Delft method; NEN 5603). To realize these minimum requirements the dosage of carbon black usually employed is about 40 parts per 100 parts of polymer in the case of synthetic rubber polymers such as ethylene-propylenediene rubber.

Since the density of active carbon black is always about 1.8, however, it is clear that, without other considerations and additions to decreasing the density, such an amount of carbon black leads to an overall density of the vulcanizate of about 1.0. Now it has surprisingly been found that if an active carbon black is used, which is distinguished from carbon black by having a particle size smaller than 35 nm (nanometer) and by having a high structure, a solid (massive) vulcanizate produced therewith has a density below 1.0. The vulcanizate so produced has an oil absorption (amount of dibutyl phthlate, DBP absrobed per 100 parts of rubber) which is more than 130 ml/100 grams and a specific area, determined by nitrogen absorption according to the BET method, of more than 130 m$^2$/g, when the amount of this carbon black added to the rubber is between 5 and 20 parts by weight per 100 parts by weight of the synthetic rubber.

The invention thus provides a floating rubber fender consisting of a rubber body or matrix in solid form comprising carbon black reinforced massive rubber (i.e. free of gas-filled or air-filled closed pores), the rubber body having been manufactured from a substantially synthetic rubber having a density not greater than substantially 0.91, reinforced with from 5 to 20 parts by weight per 100 parts by weight of said rubber of a carbon black of particle size smaller than 35 nm (nanometer) and high structure so that the DBP oil absorption is higher than 130 ml/100 grams and with a specific surface (BET method) of more than 130m$^2$/g. The completed rubber body has a density not exceeding 1.0 and generally no more than 0.97 and has a modulus at 25% elongation of at least3.5 kg/cm$^2$ and a tear resistance of at least 10 kg/cm$^2$. The rubber body has no closed gas or air filled pores.

The shape of the fender may vary and include open cavities (which do not add to the floating capacity). Thus the fender may have the form of a thick-walled hollow cylinder. Suitable dimensions for these hollow cylinders are: a length of 2–4 m; outer diameter between 0.3 and 2 m; inner diameter varying accordingly between 0.15 and 1.5 m.

Any type of carbon black fulfilling the abovementioned requirements can be used. A suitable carbon black is e.g. Vulcan XC 72 having a particle size of about 29 nm, an oil absorption of 180 ml/100 g and a specific surface of 180 m$^2$/g. Preferably, however, a carbon black having the highest structure (highest oil absorption value and specific surface) is used. Such a carbon black is the carbon black put on the market by AKZO N.V. under the name Ketjenblack EC. This carbon black has an oil absorption value (ml DBP/100 grams of carbon black) of 300–400, a particle size of substantially 30 nm and a surface area of 800–1100 m$^2$/gram.

Accordingly, an object of the present invention is to provide a floating rubber fender consisting of a matrix, in solid form, of rubber having a density not exceeding 0.91 which is free of gas-filled or air-filled closed pores, and from 5–20 parts by weight per 100 parts by weight of said rubber of carbon black having a particle size smaller than 35 nanometers and which is dispersed throughout said matrix as a filler; said filler having a density not exceeding 0.97, a modulus at 25% elongation of at least 3.5 kg/cm$^2$ and a tear resistance of at least 10 kg/cm$^2$; said carbon black being incorporated as a filler in said solid form matrix of rubber solely for its small particle size and high structure, said carbon black having a dibutyl-phthalate oil absorption higher than 130 ml/100 gm and a specific surface by the BET method more than 130 m$^2$/ gm. (*Kirk-Othmer Encyclopedia of Chem. Technology,* 1st ed., Vol. 1 (1947), page 210.)

A further object of the present invention is to provide a floating fender which is rugged in construction and material.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENTS

The inventive floating fender is now illustrated in the following examples. In these examples the following basic recipe is utilized: EPDM-rubber, zinc-oxide (active), carbon black, stearic acid, resin, softener, and an accelerator system.

The amounts of the various components in this mixture are chosen such that the following conditions are met:

1. A density of at most 0.97.
2. A tear resistance of at least 10 kg/cm$^2$
3. A rigidity of at least 3.5 kg/cm$^2$ at 25% of elongation.

EXAMPLE I

| | | | |
|---|---|---|---|
| (1) | Nordel 1070 E | 90 | Parts by weight |
| (2) | Nordel 2744 | 40 | Parts by weight |
| | Zinc oxide/active | 2 | Parts by weight |
| (6) | Vulcan XC72 carbon black | 10 | Parts by weight |
| (4) | Escorez 5300 | 6 | Parts by weight |
| (7) | Mexphalt | 5 | Parts by weight |
| | Stearic acid | 1 | Parts by weight |
| (5) | BP 50 oil | 5 | Parts by weight |
| | Zincdibutyldithiocarbamate (ZDBC) | 2 | Parts by weight |
| | Tetramethylthiruamidisulfide (TMTD) | 0.5 | Parts by weight |
| | Telluriumdiethyldithiocarbamate (Tellurac) | 0.4 | Parts by weight |
| | Mercaptobenzodiazole (MBT) | 1.0 | Parts by weight |
| | Sulphur (S) | 2.0 | Parts by weight |
| | | 164.9 | Parts by weight |

EXAMPLE II

| | | | |
|---|---|---|---|
| (8) | Keltan 520 × 50 | 90 | Parts by weight |
| (9) | Keltan 578 | 40 | " |
| | Zincoxide | 2 | " |
| (3) | Ketjenbalck EC | 10 | " |
| (4) | Excorez 5300 | 6 | " |
| (7) | Mexphalt | 5 | " |
| | Stearic acid | 1 | " |
| (5) | BP50 oil | 5 | " |
| | ZDBC | 2 | " |
| | TMTD | 0.5 | " |
| | Tellurac | 0.4 | " |
| | MBT | 1.0 | " |
| | S | 2.0 | " |
| | | 164.9 | " |

EXAMPLE III

| | | | |
|---|---|---|---|
| (1) | Nordel 1070 E | 90 | Parts by weight |
| (2) | Nordel 2744 | 40 | " |
| | Zincoxide acitve | 2 | " |
| (3) | Ketjen carbon black EC | 14 | " |
| | Stearic acid | 1 | " |
| (4) | Resin: Escorez 5300 | 6 | " |

-continued

| | | | |
|---|---|---|---|
| | Softener: | | |
| (5) | BP process oil P50 | 10 | " |
| | ZDBC | 2 | " |
| | TMTD | 0.5 | " |
| | Tellurac | 0.4 | " |
| | MBT | 1 | " |
| | Sulphur | 2 | " |
| | | 168.9 | " |

The mechanical properties of a vulcanized rubber sheet (vulcanized during 20 minutes at 150° C.) from these mixtures were determined, with the following results.

Example I

Density=0.95
Tear resistance (method NEN 5603)=13 kg/cm$^2$
Modulus at 25% of elongation=3.6 kg/cm$^2$.

Example II

Density=0.95
Tear resistance (method NEN 5603)=20 kg/cm$^2$
Modulus at 25% of elongation=5.3 kg/cm$^2$.

Example III

Density=0.96
Tear resistance (method NEN 5603)=15 kg/cm$^2$
Modulus at 25% of elongation=5.0 kg/cm$^2$.

While specific embodiments of the invention have been shown and described in detail to illustrate the application of the principles of the invention, it will be understood that the invention may be embodied otherwise without departing from such principles.

What is claimed is:

1. A floating vulcanized rubber fender consisting of a matrix, in solid form, manufactured from synthetic rubber having a density not exceeding 0.91 which is free of gas-filled or air-filled closed pores, and from 5–10 parts by weight of carbon black per 100 parts by weight of said rubber, said carbon black having a particle size smaller than 35 nanometers and which is dispersed throughout said matrix as a filler; said fender having a density not exceeding 0.97, a modulus at 25% elongation of at least 3.5 kg/cm$^2$, a tear resistance of at least 10 kg/cm$^2$ and the shape of a thick-walled hollow cylinder with an outer diameter of between substantially 0.3 and 2 m. and an inner diameter varying accordingly between substantially 0.15 and 1½ m; said carbon black being incorporated as a filler in said solid form matrix of rubber solely for its small particle size and high structure, said carbon black having a dibutyl phthalate oil absorption higher than 130 ml/100 gm, and a specific surface by the BET method of more than 130 m$^2$/gm.

2. A floating fender according to claim 1 wherein said synthetic rubber consists of EDPM rubber.

3. A floating fender according to claim 1 wherein said synthetic rubber comprises ethylene-propylene-diene synthetic rubber.

4. A floating fender according to claim 1 wherein said carbon black has a dibutyl phthalate oil absorption value of from 300 to 400 ml/100 grams of carbon black, a particle size of substantially 30 nanometers, and a specific surface of at least 800 m$^2$/gm.

* * * * *